US007048348B2

(12) United States Patent
Mochizuki et al.

(10) Patent No.: US 7,048,348 B2
(45) Date of Patent: May 23, 2006

(54) INK BAG RECORDING APPARATUS INCORPORATING THE SAME

(75) Inventors: Seiji Mochizuki, Nagano (JP); Kazuo Koshino, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 252 days.

(21) Appl. No.: 09/977,995

(22) Filed: Oct. 17, 2001

(65) Prior Publication Data

US 2002/0051021 A1 May 2, 2002

(30) Foreign Application Priority Data

Oct. 17, 2000 (JP) ..... P. 2000-317088

(51) Int. Cl.
*B41J 2/195* (2006.01)

(52) U.S. Cl. ..... 347/7; 347/85; 347/86; 347/19

(58) Field of Classification Search ..... 347/85, 347/86, 19, 7
See application file for complete search history.

(56) References Cited

U.S. PATENT DOCUMENTS 5,950,403 A * 9/1999 Yamaguchi et al. ..... 53/434
6,302,527 B1 10/2001 Walker
2002/0015066 A1 * 2/2002 Siwinski et al. ..... 347/19

FOREIGN PATENT DOCUMENTS

| | | | |
|---|---|---|---|
| DE | 199 17 229 | A1 | 10/2000 |
| EP | 0 854 045 | A2 | 7/1998 |
| EP | 854045 | * | 7/1998 |
| EP | 0 872 347 | A1 | 10/1998 |
| EP | 0 882 595 | A2 | 12/1998 |
| EP | 1 000 752 | A2 | 5/2000 |
| JP | 62-184856 | A | 8/1987 |
| JP | 2000-246921 | A | 9/2000 |
| WO | WO 97/28001 | A1 | 8/1997 |
| WO | WO 98/55318 | A1 | 12/1998 |
| WO | WO 98/55322 | A1 | 12/1998 |
| WO | WO 98/55323 | A1 | 12/1998 |
| WO | WO 98/55324 | A1 | 12/1998 |
| WO | WO 98/55325 | A1 | 12/1998 |

* cited by examiner

*Primary Examiner*—Stephen D. Meler
*Assistant Examiner*—Ly T. Tran
(74) *Attorney, Agent, or Firm*—Sughrue Mion, PLLC

(57) ABSTRACT

A flexible ink bag in which ink consumed by a printer is stored is detachably mounted in the printer. A non-contact type memory IC is provided on the ink bag. A data communicator opposes to the memory IC to perform non-contact data communication. The memory IC stores data indicating an amount of ink remained therein. The ink bag is mounted such that the memory IC is substantially immovable with respect to the printer, regardless of the consumption of ink.

35 Claims, 4 Drawing Sheets

INK BAG RECORDING APPARATUS INCORPORATING THE SAME

BACKGROUND OF THE INVENTION

The present invention relates to an ink bag used in an ink jet printer, a facsimile machine, a copying machine or the like which comprises a mechanism for ejecting an ink droplet from a nozzle to print on a recording medium, and also relates to apparatuses incorporating such an ink bag.

As an ink bag used in such a printer, there has been known one which employs a flexible casing which is deformable in accordance with consumption of ink therein, and provided with an identification mark on the outer surface thereof. Attribute data such as the kind, color, manufactured date etc. of the ink is indicated by the identification mark. The attribute data of the ink is read from the identification mark by a reading unit provided in the printer in a state where the ink bag is attached to the printer so that the printing operation of the printer is controlled based on the data thus read.

However, in the related ink bag, the attribute data of the ink is unilaterally read from the identification mark to control the printing operation, whilst a consumed amount of the ink within the ink bag is managed by a control unit in the printer. When the ink bag is mounted on the printer, the data, which includes the consumed amount of the ink within the ink bag, stored in the control unit is cleared, then new data is read from the identification mark, and the management of the consumed amount of the ink is newly started. Thus, in the case where an ink bag is detached from the printer on the way of using the ink in a state that the consumed ink amount data is left in the printer, the consumed ink amount data no longer can be managed continuously even though the same ink bag is again mounted on the printer. Further, since a bar code whose data capacity is small is typically used as the identification mark, sufficient management data can not be treated.

SUMMARY OF THE INVENTION

The invention has been made in view of the aforesaid problems of the related technique, and object of the invention is to provide an ink bag which is capable of managing a sufficient amount of consumed ink amount data independently at every ink bag, and a printer incorporating such an ink bag.

In order to achieve the above object, according to the present invention, there is provided an ink bag for storing ink therein;

a flexible bag body, which is deformable in accordance with consumption of the ink;

an ink supply port, from which the ink stored therein is supplied; and a non-contact type memory IC, provided on the bag body.

Preferably, the memory IC stores data indicating an amount of ink remained therein.

In this configuration, the remained ink amount data can be carried and managed with each ink bag. Accordingly, in the case where, after removing the ink bag from one printer on the way of using the ink, the ink bag thus removed is again mounted on the same printer or mounted on another printer, the consumed ink amount data can be managed continuously. In a case where a flexible ink bag is adopted as in the present invention, its outline shape is changed such that a thickness of the bag becomes thin in accordance with consumption of ink therein. Even in such a case, data communication can be precisely conducted by setting proper communicatable distance between the non-contact type memory IC and the data communicator. Further, in such a case, since the positional accuracy of the non-contact type memory IC is not so strict, the memory IC can be attached on the flexible ink bag with no difficulty. Further, since the flexible ink bag is adopted, the bulk of the ink bag can be made small when the waste ink bag in which ink stored therein is entirely used is disposed.

Preferably, the bag body includes a first part having a first flexibility and a second part having a second flexibility which is lower than the first flexibility.

Here, it is preferable that the memory IC is provided in the second part of the bag body.

In this configuration, since the memory IC can be held stably on the bag body, the non-contact data communication can be made accurately between the memory IC and a data communicator provided in the printer.

Further, it is preferable that the second part is an outer peripheral portion of the bag body.

In this configuration, since the memory IC is provided on a place where is less deformed in accordance with the ink consumption, the data communication can be made precisely.

Still preferably, the outer peripheral portion of the bag body is formed by heat-welding outer peripheral portions of flexible sheet members.

In this configuration, since the memory IC is provided at the heat-welded portion which is flat and rigid, the memory IC is held stably without moving randomly. Thus, the data communication can be made accurately.

Alternatively, the memory IC may be provided in the first part of the bag body. Here, it is preferable that the first part includes at least a center portion of the bag body.

In this configuration, when the ink bag is mounted in the printer such that the center portion of the ink bag body at which the memory IC is provided is directed downward, the weight of the ink bag always acts on the memory IC regardless of the shape variation of the ink bag due to ink consumption. Accordingly, the non-contact data communication can be performed accurately between the memory IC and the data communicator.

Preferably, the memory IC is placed in the vicinity of the ink supply port.

In this configuration, since the memory IC is provided on a place where is to be secured to a recording apparatus, it is stably held in a predetermined position. Therefore, the non-contact data communication can be conducted precisely and stably.

According to the present invention, there is also provided a recording apparatus, comprising:

a flexible ink bag for storing ink consumed by the recording apparatus therein, on which a non-contact type memory IC is provided, the ink bag being deformable in accordance with the consumption of ink, and detachably provided in the recording apparatus; and a data communicator, which opposes to the memory IC to perform non-contact data communication therewith.

In this configuration, the printing operation control and the consumed ink amount management can be performed by the non-contact data communication between the memory IC and the data communicator.

Here, it is preferable that the memory IC stores data indicating an amount of ink remained therein.

In this configuration, the remained ink amount data can be carried and managed with each ink bag. Accordingly, in the case where, after removing the ink bag from one printer on the way of using the ink, the ink bag thus removed is again mounted on the same printer or mounted on another printer, the consumed ink amount data can be managed continuously.

Preferably, the ink bag is mounted such that the memory IC is directed downward.

In this configuration, since the weight of the ink bag always acts on the memory IC regardless of the shape variation of the ink bag due to ink consumption. Accordingly, the non-contact data communication can be performed accurately between the memory IC and the data communicator.

Preferably, the recording apparatus further comprises: a cartridge casing, which houses the ink bag therein; and a chamber section, which houses the cartridge casing therein.

In this configuration, the ink bag is accurately positioned within the recording apparatus through use of the cartridge casing. Accordingly, the non-contact data communication can be conducted precisely.

Here, it is preferable that the cartridge casing is formed with an aperture through which the data communication between the memory IC and the data communicator is conducted.

In this configuration, the non-contact data communication is not cut off by the cartridge casing to attain precise data communication. Accordingly, even a device having relatively low communication ability can be adopted.

Further, it is preferable that the cartridge casing is formed with an outlet to which an ink supply port of the ink bag is secured. The memory IC is placed in the vicinity of the ink supply port.

In this configuration, the memory IC can be held thereat stably. Preferably, a consumed amount of ink is judged in accordance with information indicated by the memory IC to recognize precise consumed amount of ink.

According to the present invention, there is also provided an ink bag detachably provided in a printer, for storing ink consumed by the printer therein, comprising:

a flexible bag body, which is deformable in accordance with the consumption of ink; and a non-contact type memory IC, provided on the flexible bag body so as to substantially immovable with respect to the printer regardless of the consumption of ink.

Preferably, the memory IC is placed on an outer peripheral portion of the bag body.

Here, it is preferable that the outer peripheral portion of the bag body is formed by heat-welding outer peripheral portions of flexible sheet members.

Alternatively, the memory IC is provided on an outer surface of the bag body which directs downward with respect to the printer.

BRIEF DESCRIPTION OF THE DRAWINGS

The above objects and advantages of the present invention will become more apparent by describing in detail preferred exemplary embodiments thereof with reference to the accompanying drawings, wherein like reference numerals designate like or corresponding parts throughout the several views, and wherein.

DETAILED DESCRIPTION OF THE PREFERRED EMBODIMENTS

The first embodiment of the invention will be explained with reference to FIGS. 1 to 4.

Figure 1:
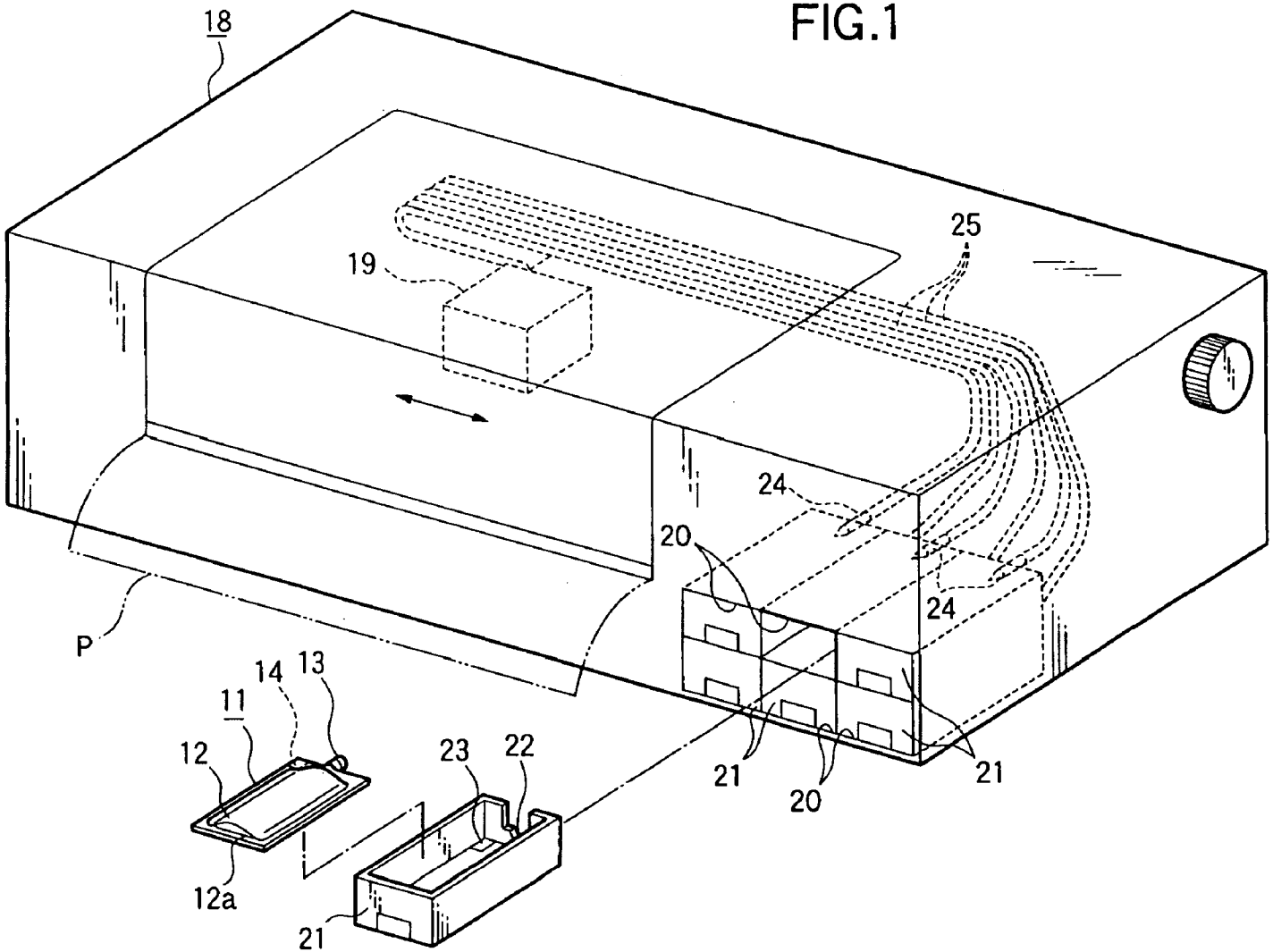
FIG. 1 is a perspective view showing a printer incorporating an ink bag unit according to a first embodiment of the invention.
Figure 2:
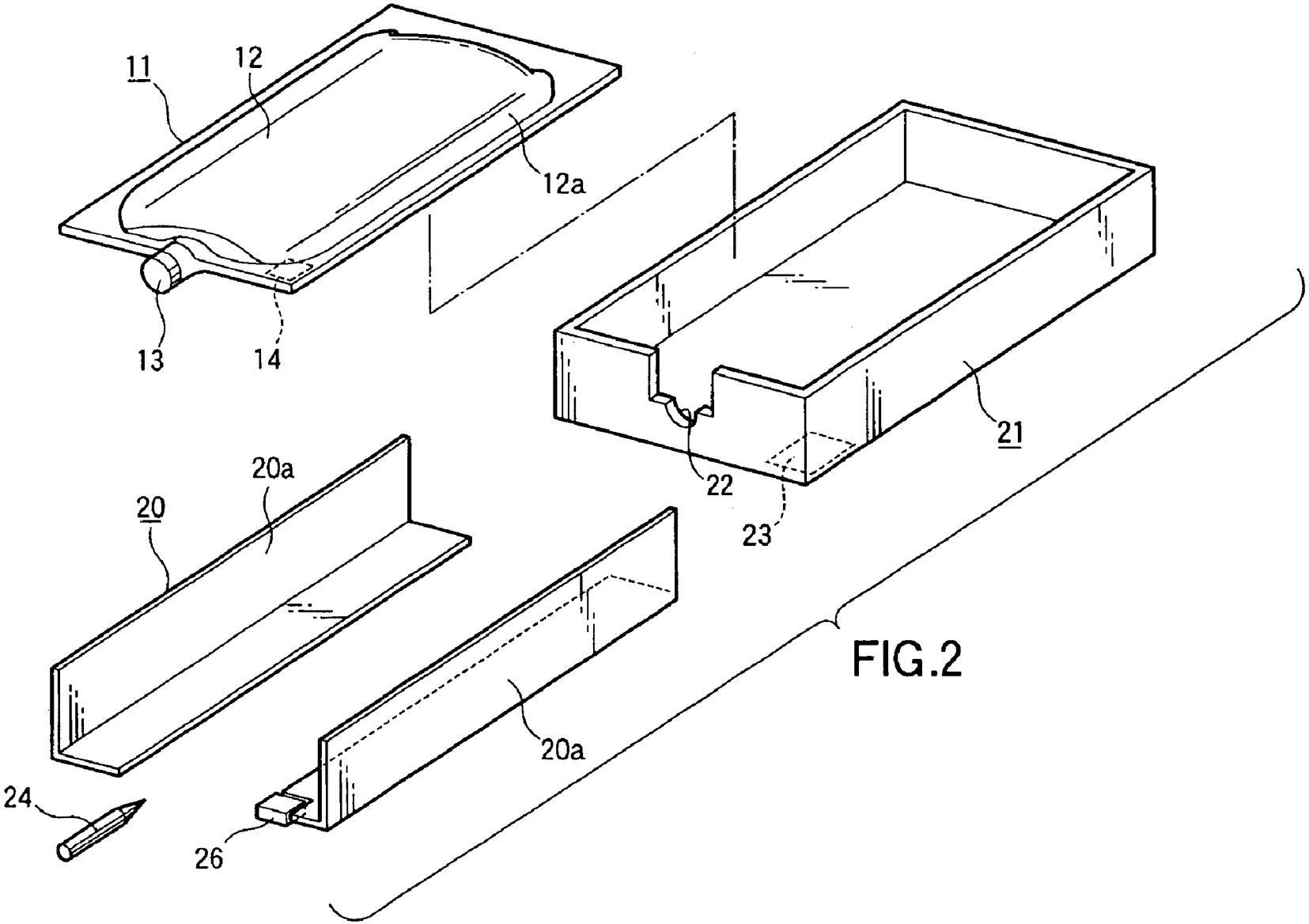
FIG. 2 is an exploded and enlarged perspective view showing the ink bag and the configuration for mounting the ink bag.
Figure 3:
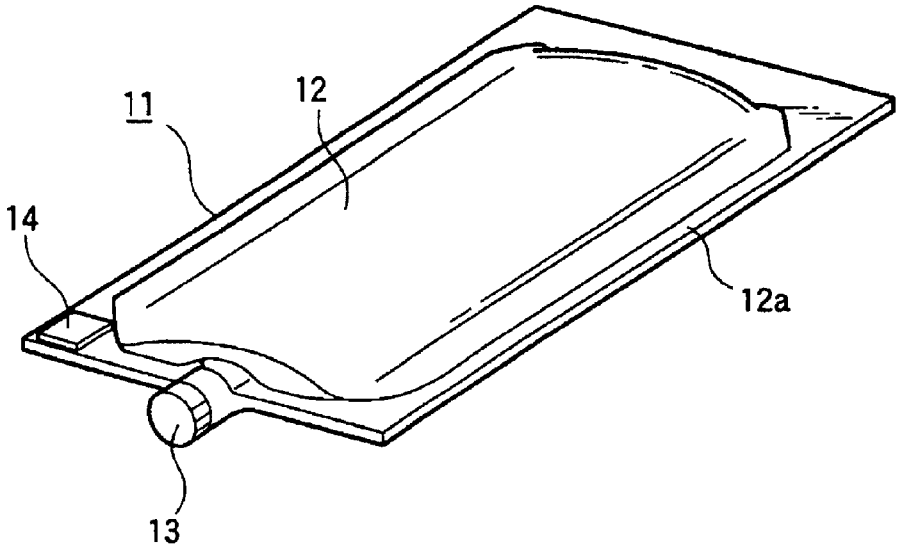
FIG. 3 is a perspective bottom view of the ink bag.

First, the explanation will be made as to an ink bag and a recording apparatus incorporating the same according to the embodiment. As shown in FIGS. 1 to 3, the ink bag body 12 of an ink bag 11 is formed by a flexible sheet members and configured in a manner, for example, that flexible sheet members such as gas-barrier laminate films each formed by depositing aluminum on a polyethylene film are overlapped, and heat welding seal is performed along the outer periphery of the overlapped sheet members to form a welded portion 12*a*. Ink used for printing is stored within the ink bag body. An ink supply port 13 formed by hard material such as composite resin etc. is provided at the one end edge of the ink bag body 12 by heat welding so that the ink within the ink bag body 12 is taken out from the ink supply port 13.

A non-contact type memory IC 14 is fixed on a lower face of the welded portion 12*a* at one corner portion thereof which is situated in the vicinity of the ink supply port 13. Attribute data relating to the ink within the ink bag 11 such as the kind, color, manufactured date, manufacturing factory etc. of the ink is stored in the memory IC 14. Further, the memory IC 14 is provided with a storage area for writing a consumed amount and a remaining amount of the ink within the ink bag 11. Thus, it is configured that the data communication (reading/writing) can be performed with respect to the memory IC 14.

Then, the explanation will be made as to the printer incorporating the ink bag. As shown in FIGS. 1 and 2, a printing head 19 is disposed in a printer body 18 so as to be movable along a not-shown platen. A plurality of bag unit chambers 20 are formed in a compartmentalization manner on a front face of the printer body 18. Each of the bag unit chambers 20 is provided with a pair of guide plates 20*a*. The ink bag 11 is first housed within a cartridge casing 21. Then each cartridge casing 21 is accommodated within the associated bag unit chamber 20.

The cartridge casing 21 is formed in a hard casing fashion. An outlet 22 is formed at one end face of the cartridge casing 21 so that the ink supply port 13 of the ink bag 11 housed within the cartridge casing 21 is secured to the outlet 22 while being protruded therefrom. A window 23 is formed at the a bottom face of the cartridge casing 21 at a portion closer to the outlet 22 such that the memory IC 14 is exposed downward from the window 23 when the ink bag 11 is housed within the cartridge casing 21.

Ink supply needles 24 are disposed in an opposite manner at the bag unit chambers 20 of the printer body 18 and coupled to the printing head 19 through ink supply tubes 25, respectively. When the cartridge casing 21 housing the ink bag 11 is inserted into the bag unit chamber 20, the ink supply needle 24 pierces through the ink supply port 13 of the ink bag 11 and is inserted within the ink bag body 12. In this state, the ink within the ink bag 11 is supplied to the printing head 19 through the supply needle 24 and the ink supply tube 25 in accordance with the printing operation of the printing head 19 thereby to print on a recording sheet P.

A data communicator 26 is disposed at the end portion of one of the pair of the guide plates 20*a* of each bag unit chamber 20. When the ink bag 11 is set at the bag unit chamber 20 in the state that the ink bag is housed within the cartridge casing 21, the memory IC 14 is disposed in the vicinity of the ink supply port 13 so as to oppose to the data communicator 26 through the window 23. In this state, the reading and writing operations of the attribute data, the consumed amount data and the remaining amount data of the ink within the ink bag 11 are performed in a non-contact state with respect to the memory IC 14.

Figure 4:
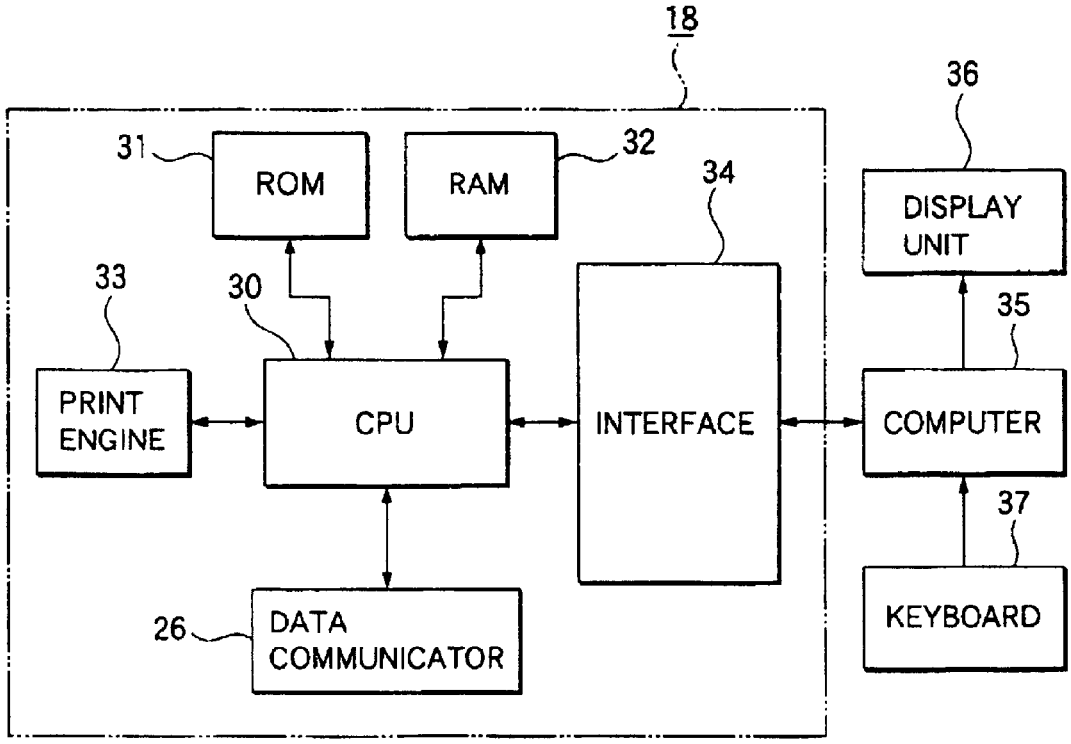
FIG. 4 is a block diagram showing the circuit configuration of the printer.

Next, explanation will be made as to the circuit configuration of the printer configured in the aforesaid manner. As shown in FIG. 4, the printer body 18 is provided with a central processing unit (CPU) for controlling the entire operation of the printer. A read only memory (ROM) 31 storing programs therein and a random access memory (RAM) 32 storing working data etc. therein are coupled to the CPU 30. A print engine 33 including the printing head 19 is coupled to the CPU 30 so that an operation signal is outputted to the print engine 33. The CPU 30 is coupled to the data communicator 26 so that the ink attribute data etc. is communicated with respect to the memory IC 14 via the data communicator 26.

An external computer 35 is coupled to the CPU 30 within the printer body 18 through an interface 34 so that print data, an alarm display signal etc. are communicated between the computer 35 and the CPU 30. A display unit 36 such as a display apparatus is coupled to the computer 35 so that an alarm message is displayed on the display unit 36 when the alarm display signal is outputted to the computer 35 from the CPU 30. A key board 37 is coupled to the computer 35 so that various kinds of data is inputted to the computer from the key board 37.

Next, the operation of the printer configured in the aforesaid manner will be explained.

As is described the above, when the ink bag 11 is mounted on the printer, the ink bag 11 is set at the bag unit chamber 20 of the printer body 18 in the state that the ink bag 11 is housed within the cartridge casing 21. Thus, the supply needle 24 pierces through the ink supply port 13 of the ink bag 11 and is inserted within the ink bag body 12. In this state, the memory IC 14 provided on the lower face of the ink bag 11 is opposed to the data communicator 26 through the window 23.

In this state, the attribute data etc. in connection with the ink within the ink bag 11 is read from the memory IC 14 by the data communicator 26 and written into the RAM 32 through the CPU 30. Then, the print engine 33 including the printing head 19 performs the printing operation based on the communicated data, and also the ink within the ink bag 11 is supplied to the printing head 19 through the ink supply needle 24 and the ink supply tube 25 thereby to print on the recording sheet P.

At the time of the printing operation, the consumed ink amount data and the remaining ink amount data is written into the RAM 32 by the data communicator 26 based on the control of the CPU 30. The data is transferred to the memory IC 14 periodically or at a predetermined timing in the printing operation. When accumulated consumed amount of the ink written into the memory IC 14 reaches a predetermined value, the alarm display signal urging the exchange of the ink bag 11 is outputted from the CPU 30 thereby to display an alarm message such as "Ink within an ink bag is empty. Please replace the ink bag with a new one." on the display unit 36.

Even when the printing operation is terminated before the ink within the ink bag 11 becomes empty, the data relating to an amount of the ink having been consumed by the printing operations until then and a remaining amount of the ink is written into the memory IC 14 on the ink bag 11. Thus, even when the ink bag 11 is taken out from the printer in this state, then set again to another printer and used therein, a consumed amount of the ink can be managed continuously by transferring these data to the another printer.

Thus, the following advantageous effects can be attained according to the embodiment.

(1) Since it is not suitable to provide a contact type IC on a flexible ink bag, a remaining ink amount data is written into the non-contact type memory IC 14 provided on the flexible ink bag 11 so that the consumed ink amount data can be carried and managed with each ink bag 11. Accordingly, in the case where, after removing the ink bag 11 from one printer on the way of using the ink, the ink bag 11 thus removed is again mounted on the same printer or mounted on another printer, the consumed ink amount data can be managed continuously. In a case where a flexible ink bag is adopted as in the present invention, its outline shape is changed such that a thickness of the bag becomes thin in accordance with consumption of ink therein. Even in such a case, data communication can be precisely conducted by setting proper communicatable distance between the non-contact type memory IC and the data communicator. Further, in such a case, since the positional accuracy of the non-contact type memory IC is not so strict, the memory IC can be attached on the flexible ink bag with no difficulty. Further, since the flexible ink bag is adopted, the bulk of the ink bag can be made small when the waste ink bag in which ink stored therein is entirely used is disposed.

(2) Since the memory IC 14 is disposed on the welded portion 12*a* having greater stiffness in comparison with any other portion of this ink bag 11, the memory IC 14 can be held stably thereon so as to oppose to the data communicator 26 closely and stably. Therefore, the data communication can be made accurately in a non-contact state between the memory IC 14 and the data communicator 26. Further, the welded portion is not so deformed in accordance with the ink consumption, it is possible to adopt a device in which a communicatable distance between the non-contact type memory IC and the data communicator is small.

(3) Since the data communicator 26 is provided in the printer so as to closely oppose to the memory IC 14 provided on the ink bag 11, the control of the printing operation and the management of the consumed ink amount can be efficiently performed by the data communication therebetween.

(4) Since the data communication is performed in a state that the memory IC 14 is directed downward, the weight of the ink bag 11 always acts on the memory IC 14 so as to keep the stable attitude of the memory IC 14. Accordingly, the data communication between the memory IC 14 and the data communicator 26 can be surely performed.

Next, the second embodiment of the invention will be explained mainly as to portions different from the first embodiment.

Figure 5:
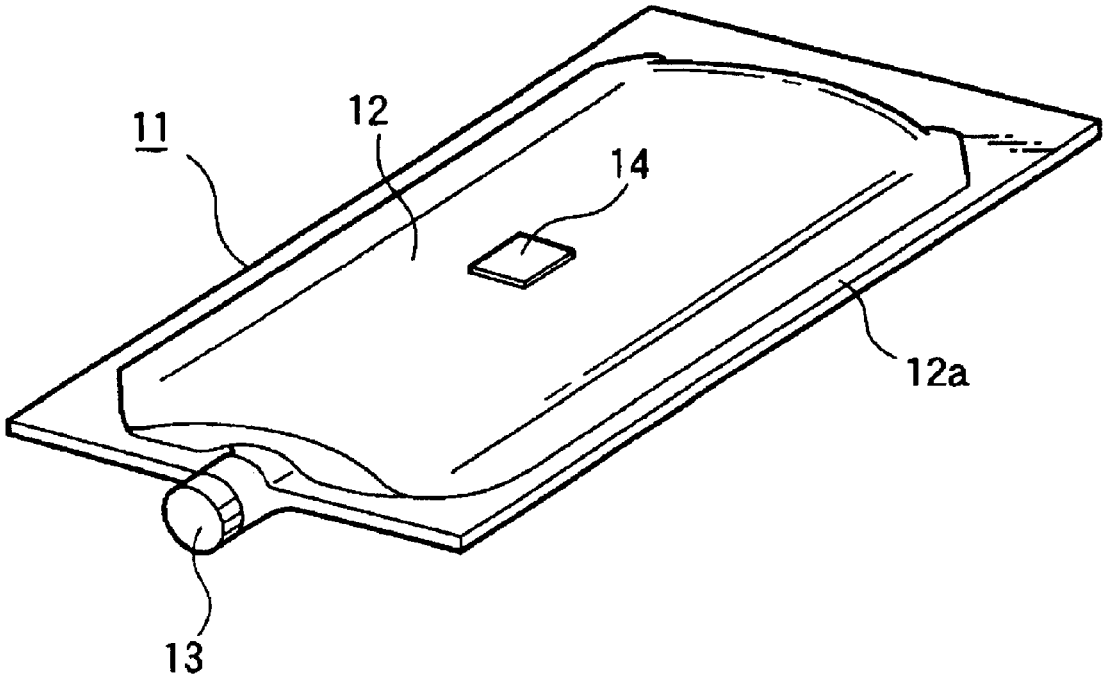
FIG. 5 is a perspective bottom view showing an ink bag according to a second embodiment of the invention.

In the second embodiment, as shown in FIG. 5, a non-contact type memory IC 14 is pasted at the center portion of the lower side surface of an ink bag body 12. On the other hand, the data communicator 26 of a printer is provided at a center portion of a cartridge casing 21 (not shown). When the ink bag 11 is set in a bag unit chamber 20 of the printer in a state where the ink bag is housed within the cartridge casing 21, the memory IC 14 is disposed so as to oppose to the data communicator 26 disposed between the guide plates 20*a* of the bag unit chamber 20.

Thus, according to the second embodiment, the following advantageous effect can be attained in addition to the aforesaid effects of the first embodiment described in (1), (3) and (4).

(5) Since the ink bag 11 is set in the printer in a manner that the center portion of the ink bag body 12 at which the memory IC 14 is provided is directed downward, the memory IC 14 is provided at the center portion of the outer surface of the ink bag body 12, the memory IC 14 can be always made closely oppose to the data communicator 26 with a fixed distance, regardless of the shape variation due to ink consumption of the ink bag 11. Accordingly, the data can be communicated accurately in a non-contact state between the memory IC 14 and the data communicator 26. Further, it is possible to adopt device in which a communicatable distance between the non-contact type memory IC and the data communicator is small.

Here, the position of memory IC 14 is not limited as shown in FIG. 5, the memory IC 14 may be positioned anywhere if it is substantially immovable with respect to the data communicator, regardless of the ink consumption.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

For example, in the configuration described as the first embodiment, the memory IC 14 may be disposed anywhere on the welded portion 12*a* formed on the outer periphery of the ink bag body 12. Further, the memory IC 14 may be provided on the outer periphery so as to be directed upward.

When the first embodiment is modified in this manner, the effects almost similar to those of the first embodiment can be attained.

Furthermore, the position of the memory IC 14 is not limited to the center portion of the lower side surface of the ink bag body, as in the second embodiment. The memory IC 14 may be placed anywhere if it is substantially immobile with respect to the cartridge case 21 regardless of the consumption of ink therein.

What is claimed is:

1. An ink bag for storing ink therein, comprising a flexible bag body, which is deformable in accordance with consumption of the ink;

an ink supply port, from which the ink stored therein is supplied; and a non-contact type memory IC, provided on the bag body, wherein:

the bag body includes a first part having a first flexibility and a second part having a second flexibility which is lower than the first flexibility; and the memory IC is provided in the second part of the bag body.

2. The ink bag as set forth in claim 1, the second part is an outer peripheral portion of the bag body.

3. The ink bag as set forth in claim 2, wherein the outer peripheral portion of the bag body is formed by heat-welding outer peripheral portions of flexible sheet members.

4. An ink bag for storing ink therein, comprising:

a flexible bag body, which is deformable in accordance with consumption of the ink;

an ink supply port, from which the ink stored therein is supplied; and a non-contact type memory IC, provided on the bag body, wherein:

the bag body includes a first part having a first flexibility and a second part having a second flexibility which is lower than the first flexibility; and, the memory IC is provided in the first part of the bag body.

5. The ink bag as set forth in claim 4, wherein the first part includes at least a center portion of the bag body.

6. The ink bag as set forth in claim 1 or 4, wherein the memory IC stores data indicating an amount of ink remaining therein.

7. The ink bag as set forth in claim 1 or 4, wherein the memory IC is placed in the vicinity of the ink supply port.

8. A recording apparatus, comprising:

a flexible ink bag for storing ink consumed by the recording apparatus therein, on which a non-contact type memory IC is provided, the ink bag being deformable in accordance with the consumption of ink, and detachably provided in the recording apparatus; and a data communicator, which opposes to the memory IC to perform non-contact data communication therewith, wherein:

the bag body includes a first part having a first flexibility and a second part having a second flexibility which is lower than the first flexibility; and the memory IC is provided in the second part of the bag body.

9. The recording apparatus as set forth in claim 8, wherein the ink bag is mounted such that the memory IC is directed downward.

10. The recording apparatus as set forth in claim 8, wherein the memory IC stores data indicating an amount of ink remaining therein.

11. The recording apparatus as set forth in claim 8, further comprising:

a cartridge casing, which houses the ink bag therein; and a chamber section, which houses the cartridge casing therein.

12. The recording apparatus as set forth in claim 11, wherein the cartridge casing is formed with an aperture through which the data communication between the memory IC and the data communicator is conducted.

13. The recording apparatus as set forth in claim 11, wherein:

the cartridge casing is formed with an outlet to which an ink supply port of the ink bag is secured; and the memory IC is placed in the vicinity of the ink supply port.

14. The recording apparatus as set forth in claim 8, wherein a consumed amount of ink is judged in accordance with information indicated by the memory IC.

15. An ink bag detachably provided in a printer, for storing ink consumed by the printer therein, comprising:

a flexible bag body, which is deformable in accordance with the consumption of ink; and a non-contact type memory IC, provided on the flexible bag body so as to be substantially immovable with respect to the printer, regardless of the consumption of ink, wherein:

the bag body includes a first part having a first flexibility and a second part having a second flexibility which is lower than the first flexibility; and the memory IC is provided in the first part of the bag body.

16. The ink bag as set forth in claim 15, wherein the memory IC is placed on an outer peripheral portion of the bag body.

17. The ink bag as set forth in claim 16, wherein the outer peripheral portion of the bag body is formed by heat-welding the outer peripheral portions of flexible sheet members.

18. The ink bag as set forth in claim 15, wherein the memory IC is provided on an outer surface of the bag body which directs downward with respect to the printer.

19. A container, comprising:

a flexible bag adapted to hold a liquid;

a memory attached to the bag; wherein the memory is a non-contact integrated circuit; and a housing for housing the flexible bag, the housing formed with an aperture to expose the memory, the aperture enabling non-contact data communication between the memory and a device external to the housing.

20. The container as in claim 19, wherein the liquid comprises ink; and, wherein the bag is flexible and deformable with the consumption of a quantity of ink supplied therein.

21. The container as in claim 20, wherein the bag further includes an ink supply port adapted to supply the ink.

22. The container of claim 19, wherein the aperture is formed completely through the housing to expose the non-contact type memory IC to the device external to the housing.

23. A recording apparatus, comprising:

a flexible ink bag for storing ink consumed by the recording apparatus therein, on which a non-contact type memory IC is provided, the ink bag being deformable in accordance with the consumption of ink and detachably provided in the recording apparatus; and a data communicator, which opposes the memory IC and performs non-contact data communication therewith; wherein:

the bag body includes a first part having a first flexibility and a second part having a second flexibility which is lower than the first flexibility; and the memory IC is provided in the first part of the bag body.

24. The recording apparatus as set forth in claim 23, wherein the ink bag is mounted such that the memory IC is directed downward.

25. The recording apparatus an set forth in claim 23, wherein the memory IC stores data indicating an amount of ink remaining therein.

26. The recording apparatus as set forth in claim 23 further comprising:

a cartridge casing, which houses the ink bag therein; and a chamber section, which houses the cartridge casing therein.

27. The recording apparatus as set forth in claim 23, wherein a consumed amount of ink is judged in accordance with information indicated by the memory IC.

28. An ink bag detachably provided in a printer, for storing ink consumed by the printer therein, comprising:

a flexible bag body, which is deformable in accordance with the consumption of ink; and a non-contact type memory IC, provided on the flexible bag body so as to be substantially immovable with respect to the printer, regardless of the consumption of ink, wherein:

the bag body includes a first part having a first flexibility and a second part having a second flexibility which is lower than the first flexibility; and the memory IC is provided in the second part of the bag body.

29. The ink bag as set forth in claim 28, wherein the memory IC is provided on an outer surface of the bag body which directs downward with respect to the printer.

30. An ink bag system for storing ink therein:

a flexible bag body, which is deformable in accordance with consumption of the ink;

an ink supply port, from which the ink stored therein is supplied;

a non-contact type memory IC, provided on the bag body; and a housing which houses the ink bag therein, the housing formed with an aperture that provides a communication path from the non-contact type data IC to a device external to the housing.

31. The ink bag system of claim 30, wherein the aperture is formed completely through the housing to expose the non-contact type memory IC to the device external to the housing.

32. A recording apparatus, comprising:

a flexible ink bag for storing ink consumed by the recording apparatus therein, on which a non-contact type memory IC is provided, the ink bag being deformable in accordance with the consumption of ink;

a housing which houses the ink bag therein, the housing formed with an aperture that provides a communication path from the non-contact type data IC to a device external to the housing; said housing being detachably provided in the recording apparatus; and a data communicator in the recording apparatus, which opposes the memory IC when the housing is installed in the recording apparatus, said data communicator performing non-contact data communication with said memory IC through the aperture of the housing.

33. The recording apparatus of claim 32, wherein the aperture is formed completely through the housing to expose the non-contact type memory IC to the data communicator.

34. An ink bag detachably provided in a printer, for storing ink consumed by the printer therein, comprising:

a flexible bag body, which is deformable in accordance with the consumption of ink;

a non-contact type memory IC, provided on the flexible bag body so as to be substantially immovable with respect to the printer, regardless of the consumption of ink; and a housing for housing the ink bag, the housing formed with an aperture to enable non-contact data communication between the memory IC and the printer.

35. The ink bag of claim 34, wherein the aperture is formed completely through the housing to expose the non-contact type memory IC to the printer.

* * * * *